United States Patent [19]

Roberts

[11] 4,378,298

[45] Mar. 29, 1983

[54] IMINES OF 2,4-DIAMINODIPHENYL ETHERS AS ANTIOXIDANTS FOR LUBRICATING OILS AND GREASES

[75] Inventor: John T. Roberts, Arlington Heights, Ill.

[73] Assignee: UOP Inc., Des Plaines, Ill.

[21] Appl. No.: 262,889

[22] Filed: May 12, 1981

[51] Int. Cl.[3] ..... C10M/1/20; C10M 1/32; C10M 1/38

[52] U.S. Cl. ..... 252/47.5; 252/51.5 R; 252/402; 252/403; 564/430

[58] Field of Search ..... 252/47.5, 51.5 R, 402, 252/403; 564/430

[56] References Cited

U.S. PATENT DOCUMENTS

| | | | |
|---|---|---|---|
| 2,290,860 | 7/1942 | Burk et al. | 252/51.5 R |
| 2,910,437 | 10/1959 | Symon | 252/32 |
| 2,964,479 | 12/1960 | Cyba | 252/403 |
| 2,982,729 | 5/1961 | Thompson et al. | 252/40.7 |
| 3,093,586 | 6/1963 | Cyba | 252/51.5 R |
| 3,122,575 | 2/1964 | Peterson et al. | 252/51.5 R |

FOREIGN PATENT DOCUMENTS

| | | | |
|---|---|---|---|
| 672029 | 10/1963 | Canada | 252/51.5 R |

*Primary Examiner*—W. J. Shine

*Attorney, Agent, or Firm*—James R. Hoatson, Jr.; Eugene I. Snyder; William H. Page, II

[57] ABSTRACT

Imines of 2,4′-diaminodiphenyl ethers are effective antioxidants in petroleum and petroleum-related products. Especially desirable are 2,4′-bis-(N,N′-arylmethylideneamino)phenyl ethers, where the aryl moiety is a heteroaromatic group.

21 Claims, No Drawings

IMINES OF 2,4-DIAMINODIPHENYL ETHERS AS ANTIOXIDANTS FOR LUBRICATING OILS AND GREASES

BACKGROUND OF THE INVENTION

A persistent problem common to virtually all petroleum products and petroleum-related products is their tendency to undergo oxidative degradation. Oxidation may occur even under the relatively mild conditions attending storage and transport, and is appreciably accelerated when operating conditions are conducive to oxidation processes, for example, the elevated temperatures experienced by lubricating oil. Such oxidative processes not only cause chemical degradation of the petroleum or petroleum-related product, but may also cause appreciable changes in desirable physical properties, such as viscosity, which lead to a deterioration of product performance characteristics. Additionally, the oxidative products themselves may attack materials in contact with the petroleum and petroleum-related products, such as metals in contact with transmission or lubricating oils, thereby causing inefficient performance and, in extreme cases, even mechanical failure.

The class of N,N'-dialkyl-4,4'-diaminodiphenyl ethers is known to have substantial antioxidant properties, and has found utility as an additive protecting petroleum and petroleum-related products against oxidation in their working environment as shown in U.S. Pat. No. 2,982,729. Unsubstituted 2,4'-diaminodiphenyl ether acts as an effective stabilizer against oxidative deterioration, U.S. Pat. No. 2,910,437, and mixtures of alkylated 4,4'- and 2,4'-diaminodiphenyl ethers act synergistically as an inhibitor according to U.S. Pat. No. 2,964,479. It now has been found that certain diimines of 2,4'-diaminodiphenyl ethers are effective oxidants in the aforementioned products. In some cases these ethers display antioxidant properties exceeding those of the symmetrical diaminodiphenyl ethers, thereby permitting their effective use at relatively lower levels. The antioxidants described herein possess the further advantage that structural changes within broad, but nonetheless well-defined, limits are possible, thereby permitting optimization of the antioxidant for a particular product in a specified use.

SUMMARY OF THE INVENTION

The principal object of this invention is to provide a method of inhibiting oxidation in petroleum products and petroleum-related products by the addition thereto of effective amounts of additives having antioxidant properties, and compositions thereof. An embodiment of this invention comprises the use of imines 2,4'-diaminodiphenyl ethers as an additive in said products. In a more specific embodiment the additives are 2,4'-bis-(N,N'-arylmethylideneamino)phenyl ethers and substituted derivatives thereof. In a still more specific embodiment the additives are 2,4'-bis-(N,N'-benzylideneamino)phenyl ethers. In yet another embodiment the additives are present at a concentration from about 0.05 to about 5% by weight.

DESCRIPTION OF THE INVENTION

The materials of this invention are imines of 2,4'-diaminodiphenyl ethers. More precisely, the materials may be designated as 2,4'-bis-(N,N'-arylmethylideneamino)phenyl ethers, where the aryl group is a benzene or substituted benzene nucleus, a fused ring aromatic nucleus, or a heteroaromatic nucleus. The discovery of this invention is that the materials of such structure possess potent antioxidant properties and can be effectively used as an additive to retard and inhibit oxidation in petroleum products and petroleum-related products at concentrations as low as about 0.05% by weight.

The additives of the instant application have a common structure represented by the formula,

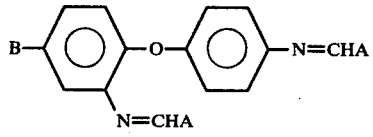

The group represented by A in the above structure is an aromatic or heteroaromatic ring. Examples of such rings include benzene, naphthalene, anthracene, chrysene, pyridine, thiophene, pyrrole, furan, imidazole, oxazole, thiazole, quinoline, carbazole, pyrimidine, purine, and so forth. Where A is the benzene ring, it will be recognized that the resulting materials are 2,4'-bis-(N,N'-benzylideneamino)phenyl ethers. In other cases, it will be recognized that the resulting materials are aromatic and heteroaromatic analogs of the bis-(N,N'-benzylideneamino)phenyl ethers.

In some cases it is advantageous to have the aromatic or heteroaromatic ring bearing at least one substituent. Among those substituents often leading to enhanced desirable properties are halogen, especially chlorine, nitro, cyano, carboxyl, and hydroxyl moieties. Another class of substituents which may be effectively used in the materials described herein comprises alkyl, alkoxy, and alkylmercapto where the carbonaceous portion contains up to about 18 carbon atoms. Examples of the latter include methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl. The carbonaceous portion is saturated and may be either a straight or branched chain, although a branched chain is preferred because of increased solubility in products where their use is intended.

The moiety represented by B in the above structure may be hydrogen, but often will be an electronegative group such as a halogen, especially chlorine, hydroxy, or an alkoxy or alkylmercapto moeity where the carbonaceous portion contains up to about 18 carbon atoms. The carbonaceous portion is saturated and may be either a straight or branched chain, with preference going to a branched chain because of increased solubility in intended products. Example of such moieties have been given above.

Examples of suitable oxidants according to the foregoing description, cited solely for illustrative purposes, include: 2,4'-bis-(N,N'-benzylideneamino)phenyl ether; 2,4'-bis-(N,N'-naphthylmethylideneamino)phenyl ether; 2,4'-bis-(N,N'-anthracenylmethylideneamino)phenyl ether; 2,4'-bis-(N,N'-pyridinylmethylideneamino)phenyl ether; 2,4'-bis-(N,N'-thienylmethylideneamino)phenyl ether; 2,4'-bis-(N,N'-furfurylideneamino)phenyl ether, and similar diimines where the heteraromatic group is imidazole, oxazole, thiazole, quinoline, carbazole, pyrimidine, and the like; 2,4'-bis-(N,N'-methylbenzylideneamino)phenyl ether; 2,4'-bis-(N,N'-t-butylbenzylideneamino)phenyl ether; 2,4'-bis-(N,N'-methoxybenzylideneamino)phenyl ether, 2,4'-bis-(N,N'-sec-pentoxybenzylideneamino)phenyl ether; 2,4'-bis-(N,N'-chlorobenzylideneamino)phenyl ether; 2,4-bis-(N,N'-fluorobenzylideneamino)phenyl ether; 2,4'-bis-(N,N'-nitrobenzylideneamino)phenyl ether; 2,4'-bis-(N,N'-methylmercaptobenzylideneamino)phenyl ether, and so forth; 2,4'-bis-(N,N'-benzylideneamino)-4-methoxydiphenyl ether; 2,4'-bis-(N,N'-benzylideneamino)-4-ethoxydiphenyl ether; 2,4'-bis-(N,N'-benzylideneamino)-4-chlorodiphenyl ether; 2,4'-bis-(N,N'-benzylideneamino)-fluorodiphenyl ether; 2,4'-bis-(N,N'-benzylideneamino)-4-bromodiphenyl ether, and so on.

Although the additives of this invention are represented as symmetrically disubstituted in the sense that each group, A, of the above is identical, it is to be understood that unsymmetrically disubstituted compounds are within the scope of this invention, i.e., each group, A, of the above formula is different while conforming to the general description and requirements of A as given above.

The preparation of these materials is not novel and suitable methods will be recognized by those skilled in the art. One preparative route is the condensation of 2,4'-diaminodiphenyl ether with an aromatic or heteroaromatic aldehyde, or mixtures of such aldehydes, to afford the Schiff base, or imine. Typically, such reaction is conducted in an inert solvent, such as an aliphatic or aromatic hydrocarbon or ethers, especially ethers of glycols and polyglycols, in the presence of an acid as catalyst, frequently p-toluenesulfonic acid or a similar acid, or Lewis acids, such as boron trifluoride, with subsequent recovery of the diimine as product. Reaction time of 8 to 16 hours at temperatures from 110° to 150° C. generally suffice.

The materials described herein may be used as antioxidants in a wide variety of petroleum and petroleum-related products, and other materials. For example, the materials may be used in lubricating oils and greases, either of synthetic or petroleum origin. Examples, cited for illustrative purposes only, include aliphatic esters, polyalkylene oxides, silicones, phosphoric and silicic acids, fluorine-substituted hydrocarbons, and the like. Lubricating oils of petroleum origin include motor lubricarting oils, railroad type lubricating oil, marine oil, transformer oil, transmission oil, turbine oil, gear oil, differential oil, diesel lubricating oil, hydraulic oil, cutting oil, rolling oil, etc. Greases include petroleum grease, whale grease, wool grease, grease from inedible and edible fats, synthetic greases, such as those from mineral or synthetic oils containing hydrocarbon-soluble metal salts of fatty acids, and so forth. The materials of this invention also are suitable for the stabilization of plastics and rubbers obtained from polymerization of various petroleum-derived materials, such as polyethylene, polypropylene, polybutadiene, polystyrene, copolymers of ethylene and butadiene, and the like, polyacrylonitrile, polyacrylates, and so forth.

The materials may be effective as an antioxidant at levels as low as about 0.05% by weight. Higher concentrations, up to about 5% by weight, may be used if desired, although it will be recognized that it is economically advantageous to use these materials at as low a concentration as will be effective.

The materials described in the examples are merely illustrative of this invention and do not limit this invention thereto.

EXAMPLE 1

To a stirred solution of 2,4'-diaminodiphenyl ether (4.0 g, 20 mmol) in xylenes (100 ml) was added 2-thiophenecarboxaldehyde (4.6 g, 21 mmol) in xylenes (50 ml). The dark colored, homogeneous solution was stirred under a nitrogen atmosphere as the reaction mixture was heated to reflux. The theoretical amount of water was collected after 4 h of heating. The reaction mixture was cooled to ambient under a nitrogen atmosphere and then concentrated on the flash evaporator to remove the solvent. The thick, black oil was heated to 70° C. under vacuum (70 mm Hg) to remove volatiles. On cooling, the material solidified to a black, waxy solid (7.5 g, 19.3 mmol, 97% yield). NMR ($CDCl_3$) δ 8.72 (s, 1H, N=CH), 7.56 (multiplet, 2H, $C_2$-H, $C_5$-H of thiophene ring). IR (neat) 1630 $cm^{-1}$, C=N stretch. This spectroscopic data is consistent with the product being the expected 2,4-bis-(N,N'-2-thienylmethylideneamino)phenyl ether.

EXAMPLE 2

A mixture of 2,4'-diaminodiphenyl ether (40 mmol) and 2-pyridinecarboxaldehyde (46 mmol) in xylenes was heated to reflux for 5 h in the presence of an acid catalyst, Amberlyst 15 TM. After the theoretical amount of water was collected, the mixture was cooled to ambient, and concentrated on the flash evaporator. Vacuum treatment (50–70 mm Hg) with heat (to 70° C.) reduced the weight of the resulting black solid to 93% of the theoretical. NMR ($CDCl_3$) δ 8.56 (s, 1H, CH=N), 8.04 (d, 1H, $C_6$-H of pyridine ring), 7.6 (t, 1H, $C_4$-H of pyridine ring); IR (melt) 1630 $cm^{-1}$ C=N stretch, consistent with the assigned structure of 2,4'-bis-(N,N'-2-pyridinylmethylideneamino)phenyl ether.

The methods of Examples 1 and 2 are representative of the preparation of the materials used in this invention.

EXAMPLES 3–9

A standardized test was used to screen the suitability of particular compounds as a stable antioxidant. Air at a constant rate of 50 ml per minute was bubbled through the test oil (a bright stock, Sentry 150 from Citgo) which is held at 275° F. in a thermostatically heated aluminum block. The test oil, to which was added the potential antioxidant, was contained in a large test tube with metal coupons of aluminum, brass, copper, and steel. Heating time for the test was a minimum of 120 hours, but was continued until the oil spot test indicated that the test sample had significantly decomposed. Upon termination of the test the acid number (AN), change in the viscosity expressed as a percentage change (ΔV %), weight gain and weight loss of the coupons were determined. It has been found that the latter data are most significant for copper coupons, thus only these are reported herein.

The oil spot test consists of placing a drop of oil on a filter paper. The appearance of the brown spot with a distinct perimeter or a spot with material at the center or with a definite ring indicates significant decomposition of the base oil. This was used to determine the length of the test subject to a five-day minimum time.

The results of testing are summarized in the accompanying table.

TABLE

PERFORMANCES OF ADDITIVES AS ANTIOXIDANTS

| Example | Additive[a,b] | SD[c] | OS[d] | AN[e] | Cu loss[f] | Δ V %[g] |
|---|---|---|---|---|---|---|
| 3 | none[h] | 120 | 3 | 5.3 | 9.5 | 33.3 |
| 4 | none | 148 | 3 | 7.37 | 14.5 | 52.0 |
| 5 | Ethyl 702[i] | 172 | 5 | 2.83 | 3.8 | 17.3 |
| 6 | A = $C_6H_5$, B = H | 172 | 6 | 1.84 | 3.7 | 15.1 |
| 7 | A = 1-naphthyl, B = H | 144 | 6 | 0.72 | 2.2 | 21.0 |
| 8 | A = 4-chlorophenyl, B = H | 144 | 6 | 0.91 | 2.6 | 10.0 |
| 9 | A = 2-chlorophenyl, B = H | 144 | 6 | 2.78 | 4.1 | 21.1 |

[a]All additives at 0.5 weight – weight % in Sentry 150.
[b]Additives have the formula shown, vide supra, with A and B being designated in this column.
[c]Total heating time in hours at 275° F.
[d]Oil spot test, indicates time of incipient decomposition in days.
[e]Acid number, ASTM D-974.
[f]Copper loss in mg.
[g]Percent change in kinematic viscosity of 100° F., $\frac{V_f - F_i}{V_i} \times 100\%$
[h]Sentry 150 as a blank.
[i]Industrial antioxidant from Ethyl Corp used as benchmark.

As the data show, the additives described in this invention lead to a substantial decrease in acid number and cause substantially less copper loss when compared to the blank. Equally important is the observation that the additives herein cause only a minor change in viscosity over the lifetime of the test.

What is claimed is:

1. A method of inhibiting oxidation in lubricating oils and greases comprising adding an antioxidant amount to said product of a material with the structure

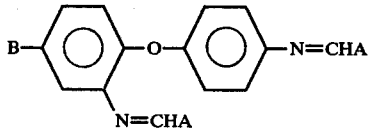

where each A is independently selected from the group consisting of unsubstituted and ring-substituted aromatic and heteroaromatic rings, and B is selected from the group consisting of hydrogen, halogen, alkoxy and alkylmercapto wherein the carbonaceous portion contains up to about 18 carbon atoms.

2. The method of claim 1 wherein A bears at least one other moiety selected from the group consisting of halogen, nitro, cyano, carboxyl, hydroxyl, alkyl, alkoxy, and alkylmercapto where the carbonaceous portion contains up to about 18 carbon atoms.

3. The method of claim 1 wherein A is an aromatic ring selected from the group consisting of benzene, naphthalene, and anthracene rings.

4. The method of claim 3 wherein A is the benzene ring.

5. The method of claim 3 wherein A is a naphthalene ring.

6. The method of claim 1 wherein the antioxidant amount of said material is from about 0.05% to about 5% by weight based on said products.

7. A composition comprising a major amount of a lubricating oil or grease and a minor antioxidant amount from about 0.05% to about 5% by weight of a material with the structure,

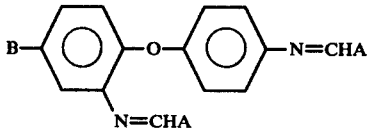

where each A is independently selected from the group consisting of unsubstituted and ring-substituted aromatic and heteroaromatic rings, and B is selected from the group consisting of hydrogen, halogen, alkoxy and alkylmercapto wherein the carbonaceous portion contains up to about 18 carbon atoms.

8. The composition of claim 7 wherein A bears at least one other moiety selected from the group consisting of halogen, alkyl, alkoxy, and alkylmercapto where the carbonaceous portion contains up to about 18 carbon atoms, nitro, cyano, carboxyl, and hydroxyl moieties.

9. The composition of claim 7 wherein A is a heteroaromatic ring selected from the group consisting of pyridene, thiophene, pyrrole, furan, imidazole, oxazole, thiazole, quinoline, and carbazole rings.

10. The composition of claim 9 wherein A is the pyridine ring.

11. The composition of claim 9 wherein A is the thiophene ring.

12. The method of claim 1 wherein A is a heteroaromatic ring selected from the group consisting of pyridine, thiophene, pyrrole, furan, imidazole, oxazole, thiazole, quinoline, and carbazole rings.

13. The method of claim 12 wherein A is the pyridine ring.

14. The composition of claim 7 wherein A is an aromatic ring selected from the group consisting of benzene, naphthalene, and anthracene rings.

15. The composition of claim 14 wherein A is the benzene ring.

16. The composition of claim 14 wherein A is the naphthalene ring.

17. A compound with the formula

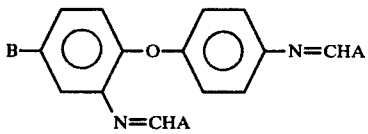

where each A is an unsubstituted or substituted heteroaromatic ring and B is selected from the group consisting of hydrogen, halogen, alkoxy and alkylmercapto wherein the carbonaceous portion contains up to about 18 carbon atoms.

18. A compound of claim 17 where each A is independently selected from the group consisting of pyridine, thiophene, furan, pyrrole, imidazole, oxazole, thiazole, quinoline, and carbazole rings.

19. A compound of claim 18 where A is pyridine.

20. A compound of claim 18 where A is thiophene.

21. A compound of claim 18 where A is furan.

* * * * *